United States Patent [19]

Rabe et al.

[11] Patent Number: 4,779,333

[45] Date of Patent: Oct. 25, 1988

[54] SLEEVE TO TUBESHEET EXPANDER TOOL

[75] Inventors: George B. Rabe, Sparta; Robert H. Johnson, Budd Lake, both of N.J.

[73] Assignee: Foster Wheeler Energy Corporation, Clinton, N.J.

[21] Appl. No.: 100,654

[22] Filed: Sep. 24, 1987

[51] Int. Cl.[4] ..... B23P 15/26; B21D 39/04; B21D 39/08

[52] U.S. Cl. ..... 29/727; 29/237; 72/58

[58] Field of Search ..... 29/157.3 C, 157.4, 421 R, 29/523, 727, 237; 72/58, 54, 393

[56] References Cited

U.S. PATENT DOCUMENTS

| | | | |
|---|---|---|---|
| 2,458,854 | 1/1949 | Hull et al. | 72/58 |
| 4,006,619 | 2/1977 | Anderson | 72/58 X |
| 4,418,457 | 12/1983 | Mueller | 29/157.4 |
| 4,567,631 | 2/1986 | Kelly | 29/157.3 C |
| 4,694,677 | 9/1987 | Rabe | 29/157.4 |

FOREIGN PATENT DOCUMENTS

| | | | |
|---|---|---|---|
| 615995 | 7/1978 | U.S.S.R. | 72/58 |

*Primary Examiner*—E. Michael Combs

*Attorney, Agent, or Firm*—Marvin A. Naigur; Warren B. Kice

[57] ABSTRACT

A pressurizable tool adapted for expanding a close-fitting sleeve into a tube in a tubesheet. The tool includes a housing containing an axially movable piston and a forward reduced diameter portion and having an elastic expander unit for inserting into the sleeve and tube in a tubesheet. The expander unit consists of at least two elastic rings composed of a polyurethane elastomer material and each having a chamfer provided at the outer edge of the unit forward and rear faces. By pressurizing a port at the housing front end, the piston is moved rearwardly to axially compress and expand the expander rings radially outwardly sufficiently to expand the sleeve firmly into the tube and provide a pressure tight seal therebetween. Following such expansion of the sleeve, the piston is pressurized and moved forward to release the compression on the expander unit rings, so that the tool can be easily withdrawn from the expanded sleeve and tube and inserted into another sleeve and tube for repeated usage.

7 Claims, 3 Drawing Sheets

FIG. 1
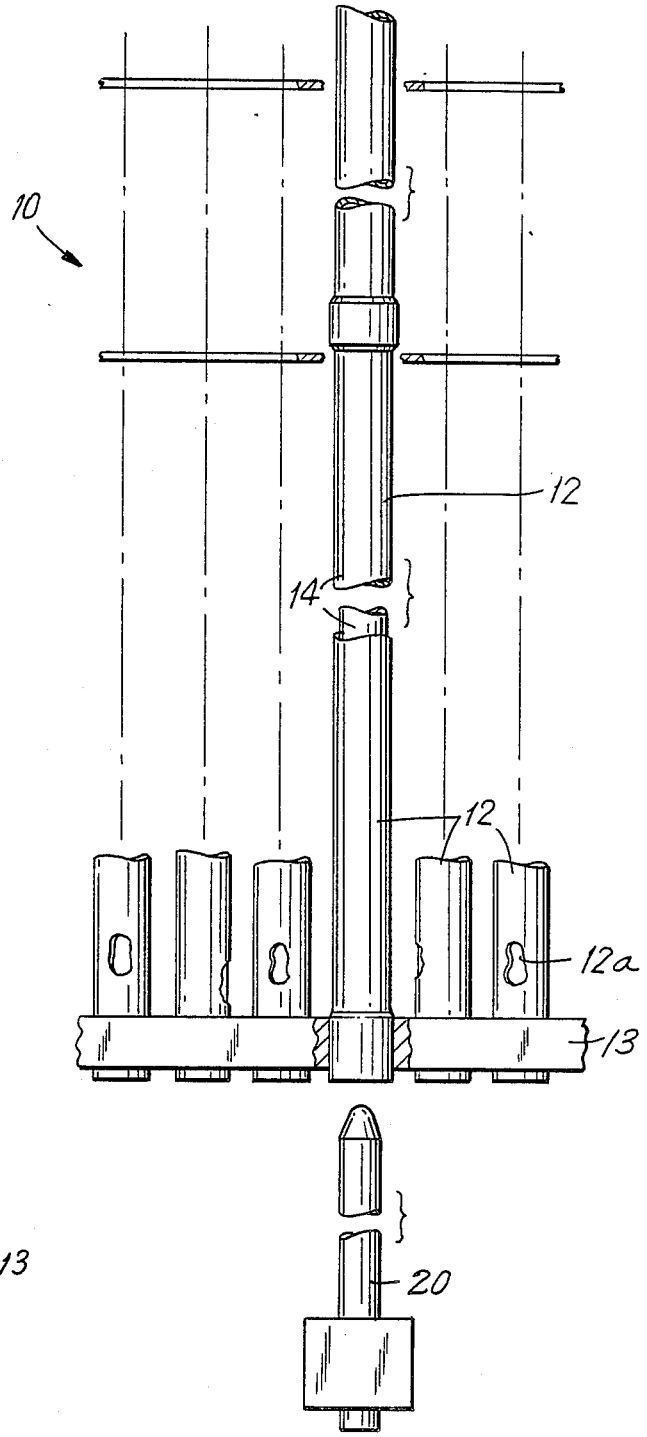
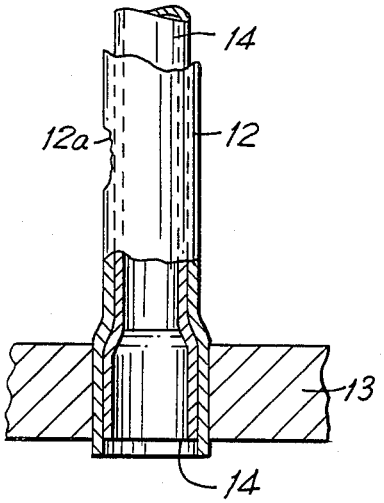
FIG. 1A

SLEEVE TO TUBESHEET EXPANDER TOOL

BACKGROUND OF INVENTION

This invention relates to a pressurizable tool adapted for expanding a sleeve firmly into a tube in a surrounding tubesheet. It relates particularly to such a tool device containing a pressurizable piston attached to an elastic expandable unit adapted for radially expanding the sleeve to provide a leak-tight seal between the sleeve and tube.

Tubes used in tubular type heat exchangers, particularly those used for air preheaters in fuel fired steam power plants, often develop leaks after several years service due to the corrosive action of the flue gases passing through the tubes, and metal erosion and/or fatigue and require repair or replacement. Such tube leaks are often located near the lower ends of the tubes adjacent a tubesheet. Because replacement of such tubes in a heat exchanger containing 10,000 to 50,000 tubes is quite expensive and requires considerable outage time for a plant, a special tool device and method has been needed for repairing such tubes quickly and economically in a dusty environment.

The prior art has disclosed various tool devices for remotely expanding tubes into tubesheets. For example, U.S. Pat. No. 2,319,216 to Dewald discloses a pull type tapered mandrel for expanding heat exchanger tubes into a tubesheet by utilizing direct contact between a tapered wedge surface and the tube inner wall to expand the tube. U.S. Pat. No. 4,068,372 to Kamohara et al discloses a tube expander for anchoring tubes in a tube plate of a heat exchanger, and utilizes a cylindrical shaped elastic medium to be expanded by axial compression utilizing a rod inserted through the medium and back up rings. U.S. Pat. No. 4,182,152 to Vaill et al discloses a grid sleeve bulge tool used for securing internal guide tools to an outer sleeve and grid. U.S. Pat. No. 4,387,507 to Kelly discloses apparatus and method for radially expanding tubes for anchoring within a tubesheet by using primary and secondary expander rings. U.S. Pat. No. 4,418,457 to Mueller discloses another apparatus for expanding a tube into a tubesheet opening and for controlling the tube expansion by axial location of elastomer washers relative to the tubesheet. Also, U.S. Pat. No. 4,567,631 to Kelly discloses another apparatus for expanding tubes into tubesheets using a plurality of elastomer expander rings loaded by axial compression. Furthermore, copending patent application, Ser. No. 833,624 filed Feb. 24, 1986 discloses a tube positioning tool and method which is generally related to the present invention. However, the prior art evidently does not disclose a pressurizable tool device adapted for conveniently and rapidly expanding a close-fitting metal sleeve firmly against a tube in a tubesheet, and which can withstand repeated cycles of use and can also be easily withdrawn from the expanded sleeve.

A special pressurizable tool and method has now been developed according to the present invention for repairing such leaking tubes by inserting a tubular metal sleeve into the tube, then inserting the tool into the sleeve and radially expanding the sleeve to seal the sleeve pressure-tight to the tube within the tubesheet. The tool utilizes multiple annular contoured elastomer expander rings which are axially compressed by a hydraulic piston means and exhibit long life during repeated high pressure usage of the tool.

SUMMARY OF INVENTION

The present invention provides a pressurizable tool device for use in effectively repairing leaking tubes in heat exchangers. The tool is adapted for being inserted into a close-fitting sleeve located within a tube for expanding the sleeve and tube firmly into an opening in a tubesheet of the heat exchanger.

The tool includes a housing having a cylindrical longitudinal bore and containing a front pressurizable port connected to the bore, and a housing closure plate containing a rear pressurizable port. A housing adapter flange having a reduced diameter portion sized to fit within the tube end is provided at the forward end of the housing to facilitate locating the tool relative to the sleeve and tubesheet. The housing cylindrical bore contains a piston axially movable therein, which piston is attached at its forward end to an elongated rod having an adjustable retainer nut threadably attached thereon. An elastic expander unit comprising at least two elastic expander rings or washers is provided encircling the rod between the housing flange and the adjustable retaining nut. The front and rear expander rings preferably each have a chamfer provided at the front outer corner of the front ring and the rear outer corner of the rear ring adjacent the retainer nut and housing flange, respectively, to minimize radial outward extrusion of each ring during repeated pressurization cycles during use of the tool.

The expander rings are composed of an elastic elastomer material which retains its elasticity through many high compression and depressurization cycles during use of the tool. Useful ring materials include polyurethane, nylon, teflon and synthetic rubber, with polyurethane elastomer being preferred because of its desirable high pressure characteristics.

This invention also includes a method for using the tool device for expanding a close-fitting metal sleeve firmly into a tube in a tubesheet such as in a heat exchanger, to provide a pressure-tight interference fit between the sleeve outer surface and the tube inner surface. In the method, the tool forward end is first inserted into the elongated metal sleeve which is positioned within the near end of a tube in a heat exchanger. The tool forward end including the retainer nut, elastic expander ring unit, and housing adapter flange forward portion are inserted fully into the sleeve, after which the housing front port is pressurized so as to move the piston rearwardly and axially compress the elastic expander rings and thereby expand them radially outwardly against the sleeve. Such expansion also expands the rear end portion of the metal sleeve radially outwardly firmly against the inner surface of the tube, which is already sealed pressure-tight within the tubesheet. The resulting Joint made by the tool forms a rear pressure-tight seal between the sleeve and the damaged tube, which was previously pressure-tightly rolled into the tubesheet opening during original manufacture of the heat exchanger.

Following such expansion of the elastic expander rings and the sleeve against the tube, the housing forward port is depressurized and the rear port is pressurized so as to move the retainer nut forward and release the axial pressure on the elastic rings. The tool is then withdrawn from the expanded sleeve and tube, and is inserted into another sleeved tube where the procedure is repeated as desired.

This invention advantageously provides a tool device adapted for being inserted into a close-fitting metal sleeve within a tube for radially expanding the sleeve into the tube to provide a pressure-tight seal therebetween. The tool utilizes dual elastomer expander rings which are each contoured to include a chamfer at the outer corners of the forward and rear faces of the seal ring unit to provide efficient radial expansion without undesirable extrusion and achieve long useful life for the rings. The invention also provides a method for repetitive use of the tool for tube repair in heat exchangers. Such effective tube repair avoids expensive rebuilding or replacement of heat exchangers, such as air preheaters in fuel fired steam power plants.

BRIEF DESCRIPTION OF DRAWINGS

This invention will be described further by reference to the following drawings, in which:

FIG. 1 shows a perspective elevation view of a heat exchanger portion containing a plurality of tubes, and the tool device used for expanding a sleeve into a tube in a tubesheet of the heat exchanger;

FIG. 1A shows an enlarged view of a sleeve expanded into a tube and tubesheet of the heat exchanger;

DESCRIPTION OF INVENTION

Figure 2:
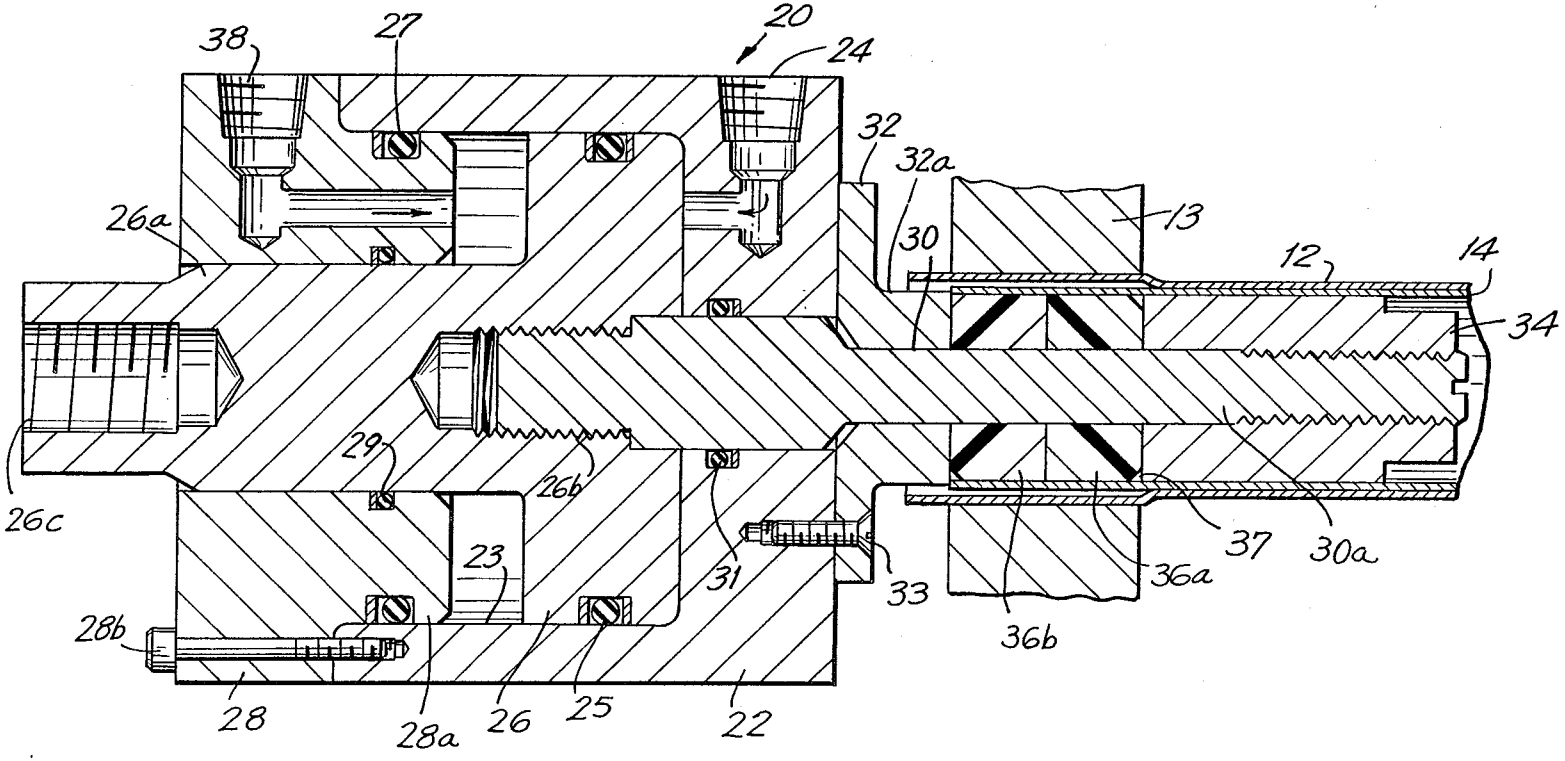
FIG. 2 shows a longitudinal cross-sectional view of the tool inserted into a sleeve and tube in a tubesheet, with the elastomer expander rings in a normal unexpanded position relative to the sleeve.

As is generally shown by FIG. 1, a vertical tubular heat exchanger 10 has a plurality of tubes 12 with their lower ends being expanded tightly into a lower tubesheet 13. Tube ruptures 12*a* in some of tubes 12 are to be repaired by inserting a sleeve 14 into each damaged tube and locally expanding the sleeve outer surface against the inner wall of the tube adjacent the tubesheet, so as to provide a pressure-tight seal at the lower end of the tube 12, as shown in greater detail by FIG. 1A. Such tube repair is provided by inserting a special tool 20 into the sleeve and radially expanding the sleeve 14 against the tube 12 according to the present invention.

As shown in FIG. 2, the pressurizable tool device 20 includes a housing 22 having a cylindrical longitudinal bore 23 and containing a pressurizable front port 24 connected to the bore. Housing 22 encloses a piston 26 axially movable in bore 23 and containing an outer seal ring 25. The housing 22 rear end is closed by a head plate 28, which has a forward portion 28*a* inserted into the cylindrical bore 23 and is attached to housing 22 by a plurality of bolts 28*b* and pressure-sealed to the housing bore 23 by outer seal ring 27. Head plate 28 is pressure-sealed around a rear extension portion 26*a* of the piston 26 by inner seal ring 29, and contains pressurizable rear port 38 flow connected to bore 23.

The piston 26 forward end is threadably attached at 26*b* to an elongated rod 30, which is pressure-sealed to housing 22 by O-ring 31. Rod 30 forward portion 30*a* has a reduced diameter and extends through an adapter flange 32, which is removably attached to the front face of the housing 22 by a plurality of threaded screws 33. Adapter flange 32 includes a front portion 32*a* having a reduced diameter which is sized to fit within a tube 12 into which a close-fitting sleeve 14 is to be expanded, so as to contact the rear end of sleeve 14 and axially locate the sleeve relative to the tube 12 and tubesheet 13. Threadably attached to the forward end 30*a* of rod 30 is a retainer nut 34, which may be tapered to facilitate inserting the nut and tool into a tube and sleeve 14.

Located between the adapter flange front portion 32*a* and nut 34 is an expander unit 36 containing 2–4 contoured elastic expander rings 36*a*, 36*b* etc. The rings are made of an elastic material which is capable of withstanding repeated high compression loading without causing permanent deformation of the rings. Useful elastic materials for rings 36 include polyurethane, nylon, teflon, and synthetic rubber, with polyurethane elastomers being preferred because of its desirable elasticity characteristics and being able to withstand numerous use cycles without permanent deformation. Polyurethane elastomer has desirable characteristics of being substantially solid under normal unpressurized conditions and behaving similar to a hydraulic liquid when highly pressurized. Polyurethane elastomer also has a memory characteristic of being able to return to substantially its original shape after a high compressive pressure has been removed. A suitable preferred material is polyurethane elastomer XPE-10 obtainable from Polaroid Corporation.

Figure 4:
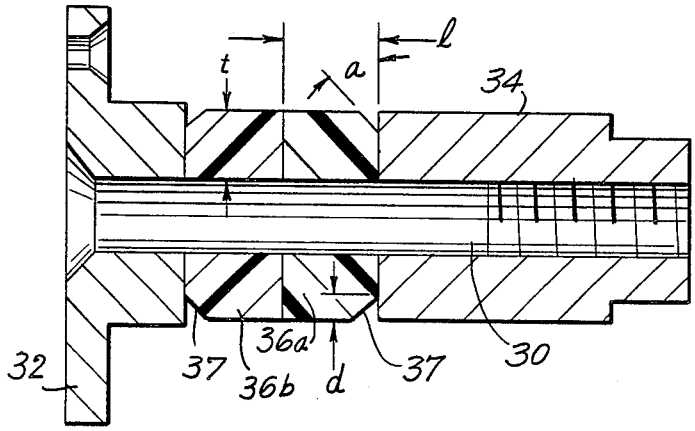
FIG. 4 shows a partial sectional view of the rod and expander ring unit of the tool.

The expander ring unit 36 is preferably provided as two annular rings or washers 36*a* and 36*b* which each preferably have equal thickness. A chamfer 37 is provided at the forward outer corner or edge of front ring 36*a* and at the rear outer corner or edge of rear ring 36*b*, and serve to retard or prevent permanent enlargement of the ring at that location due to the repeated axial loadings and high compression required for the rings during use. The chamfer 37 has an angle a of 30°–60° with the face of the ring, and has a radial dimension d equal to 15–30% of the radius of the ring, as shown in FIG. 4.

This tool device front extension portion is made to have a diameter slightly smaller than the sleeve for easy insertion into the rear end of the sleeve provided within a tube in a tubesheet. The tool extension portion length is made sufficient to extend past the tubesheet thickness and locate the expander ring unit 36 within the tubesheet thickness. The tool expander ring outside diameter is usually 1.0–2.0 inches, and fits snugly within a sleeve 14 of a tube 12, and the tool forward portion length is usually 6-12 inches depending upon the tubesheet thickness. The tool is suitably made of high strength alloy steel.

Figure 3:
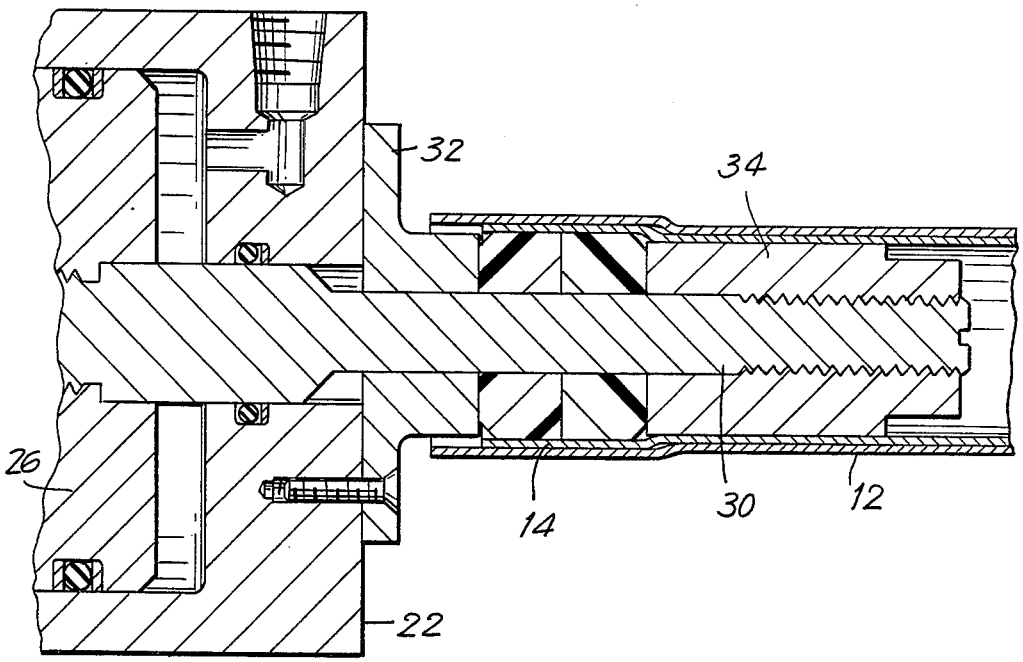
FIG. 3 shows a partial longitudinal cross-sectional view of the tool and tube with the expander rings and sleeve in an expanded position in the tube.

In the method for using the tool device for expanding a close-fitting metal sleeve into a tube in a tubesheet so as to provide a pressure-tight interference fit therebetween, the tool forward end portion is first inserted into a sleeve 14 provided in a tube 12 within a tubesheet, as shown in FIGS. 1 and 2. The front face of adapter flange 32 is usually placed against the exposed end of tube 12 and the front flange extension portion 32*a* is usually positioned substantially in alignment with the front face of tubesheet 13. The tool is connected by suitable hoses to a hydraulic pressurizing unit (not shown). The housing front port 24 is then pressurized such as to about 2000 psig hydraulic pressure, so as to move the piston 26 rearwardly and axially compress the elastic expander ring unit 36, thereby radially expanding the sleeve 14 pressure-tightly against the tube 12, as is shown by FIG. 3.

After expanding sleeve 14, the tool housing front port 24 is depressurized and the rear port 38 is pressurized, which moved forward the piston 26 and retainer nut 34 so as to release the axial loading pressure on expander ring unit 36. The tool device 20 can now be easily withdrawn from the tube, and inserted into another tube for further cycles of use for sleeve expansion into tubes. It has been found that the front expander ring 36*a* loses its resiliency first because of its loading and higher compression and greater deformation and is replaced after about 20–30 cycles of use. After another 20–30 cycles of use, both rings 36*a* and 36*b* are replaced with new expander rings by removing retainer nut 34.

This invention will be further described in terms of an example of typical operations, which should not be construed as limiting in scope.

EXAMPLE

A sleeve to tubesheet expander tool device according to this invention is constructed and used for expanding and tightly sealing a sleeve rear end into a tube in a tubesheet of a heat exchanger. The tool device and heat exchanger have the following typical dimensions and characteristics:

| | |
|---|---|
| Tube inside diameter, in. | 1.834 |
| Sleeve outside diameter, in. | 1.800 |
| Sleeve inside diameter, in. | 1.634 |
| Tool length, in. | 8 |
| Tool housing outside diameter, in. | 4 |
| Piston diameter, in. | 3.25 |
| Expander rings outside diameter, in. | 1.625 |
| Expander ring length, in. (each of two rings) | .50 |
| Piston operating pressure, psig | 2000 |

In use, the tool forward extension portion is first inserted into a metal sleeve provided in a tube of the heat exchanger, so that the expander rings are positioned in lateral alignment with the tubesheet of the heat exchanger. The tool front port is pressurized to 2000 psig by a suitable hydraulic pressurizing unit connected to the tool, which drives the piston rearwardly and compresses and expands the expander rings and swages the metal sleeve radially outwardly against the tube within the tubesheet. Then the tool housing front port is depressurized and the rear port is pressurized to 2000 psig, which moves forward the piston to release the axial force on the expander rings and permits the tool device to be withdrawn from the sleeve and tube. This procedure is repeated for each tube being repaired, using the method of the invention.

Although this invention has been described broadly and in terms of a specific embodiment, it is apparent that modifications and variations to the tool device and method of use can be made within the scope of the invention, which is defined by the following claims.

What is claimed is:

1. A pressurizable tool adapted for expanding a sleeve into a surrounding tube in a tubesheet, comprising:

a housing having a cylindrical axial bore and containing a front port connected to the bore, said housing having a forward reduced diameter portion sized to fit within the tube and contact a rear end of the sleeve;

a closure head plate having a forward portion inserted into said cylindrical bore, and containing a rear port connected to said bore;

a piston axially movable within said housing bore, said piston being attached at its forward end to an elongated rod, said rod having a retainer nut threadably attached onto the rod forward end; and an elastic expander unit encircling said rod between said housing and said retainer nut, said expander unit containing a plurality of elastomer rings and having front and rear end faces, with a chamfer being provided at an outer edge of the expander ring unit front and rear end faces, said chamfer extending from said outer edge toward the center of said ring by a radial distance equal to 15–30% of the radial thickness of said ring, whereby pressurizing the housing front port moves said piston rearwardly in the housing to axially compress the elastic expander unit against the housing so as to radially expand the expander unit firmly agains the sleeve and expand the sleeve tightly against the tube in the tubesheet.

2. A tool according to claim 1, wherein said closure plate is attached to said housing by fastener bolts and is pressure-sealed to said housing and piston by outer and inner O-ring seals.

3. A tool according to claim 1, wherein said piston has a rearward projection which extends through said closure plate and is pressure sealed to the plate.

4. A tool according to claim 1, wherein an adapter flange is rigidly attached to said housing front end, said flange having a front portion adapted to fit inside a tube and contact the rear end of the sleeve.

5. The tool according to claim 1, wherein said expander unit consists of two rings having equal thickness.

6. A tool according to claim 1, wherein said expander unit rings are composed of polyurethane elastomer.

7. A pressurizable tool adapted for expanding a sleeve into a surrounding tube in a tubesheet, comprising:

a housing having a cylindrical axial bore and containing a front port connected to the bore;

a closure head plate having a forward portion inserted into said cylindrical bore and containing a rear port connected to said bore;

a piston axially movable within said housing cylindrical bore, said piston having a rearward extension which extends through said closure plate and is attached at its forward end to an elongated rod, said rod having a retainer nut threadably attached onto its forward end;

an adapter flange rigidly attached to the front end of said housing encircling said rod, said adapter flange having a front shoulder portion sized to fit inside a tube and contact the rear end of the sleeve; and an elastic expander unit provided encircling said rod between said housing adapter flange and said retainer nut, said expander unit having front and rear end faces and containing dual elastic rings each having a chamfer located at an outer edge of the front and rear end faces, said chamfer extending from said outer edge toward the center of said ring by a radial distance equal to 15–30% of the radial thickness of said ring, whereby pressurizing the housing front port moves said piston rearwardly in said housing to axially compress the elastic expander unit against said housing adapter flange, so as to rapidly expand the expander rings firmly against the sleeve and expand the sleeve tightly against the tube in the tubesheet.

* * * * *